United States Patent [19]

Shinagawa

[11] Patent Number: 4,966,826

[45] Date of Patent: Oct. 30, 1990

[54] DIFFUSION TRANSFER PHOTOGRAPHIC FILM UNITS

[75] Inventor: Yukio Shinagawa, Kanagawa, Japan

[73] Assignee: Fuji Photo Film Co., Ltd., Kanagawa, Japan

[21] Appl. No.: 305,673

[22] Filed: Feb. 3, 1989

[30] Foreign Application Priority Data

Feb. 3, 1988 [JP] Japan ..... 63-23493

[51] Int. Cl.[5] ..... G03C 1/40; G03C 5/54

[52] U.S. Cl. ..... 430/262; 430/207; 430/260; 430/261; 430/263

[58] Field of Search ..... 430/214, 215, 216, 207, 430/220, 236, 261, 262, 263, 260

[56] References Cited

U.S. PATENT DOCUMENTS 4,629,677 12/1986 Katoh ..... 430/263

4,839,257 6/1989 Nakamura et al. ..... 430/207

*Primary Examiner*—Paul R. Michl

*Assistant Examiner*—Thorl Chea

*Attorney, Agent, or Firm*—Sughrue, Mion, Zinn, Macpeak & Seas

[57] ABSTRACT

A peel-apart type diffusion transfer unit comprising at least an image receiving layer and a peeling layer on a support wherein the peeling layer essentially consists of (A) a layer containing a copolymer which contains repeating units (monomer units) derived from an ethylenic unsaturated carboxylic acid or a salt thereof, and (B) a layer which contains a cellulose ester.

9 Claims, 1 Drawing Sheet

FIGURE
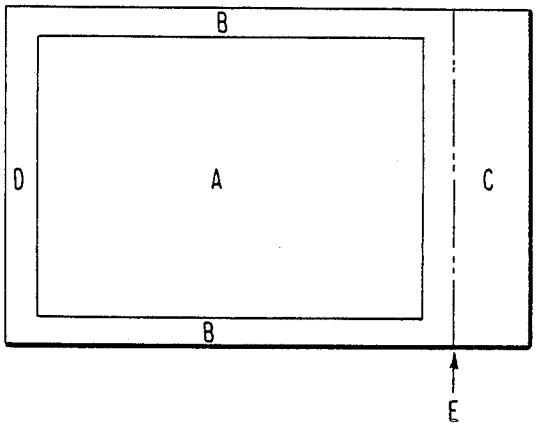

DIFFUSION TRANSFER PHOTOGRAPHIC FILM UNITS

FIELD OF THE INVENTION

This invention relates to diffusion transfer photographic film units and, more precisely, peel-apart type diffusion transfer photographic film units.

BACKGROUND OF THE INVENTION

There are various types of peel-apart diffusion transfer photographic film units, including the type in which the photosensitive layer and the image receiving layer are provided by coating on separate supports. After image exposure, the photosensitive element and the image receiving element are brought together and a processing composition is spread between them. After the image receiving layer is peeled away, a dye image which has been transferred onto the image receiving layer is obtained, as disclosed, for example, in JP-B49-26896 (the term "JP-B" as used herein means an "examined Japanese patent publication"). Also included is the type in which the photosensitive layer and the image receiving layer are provided by coating on the same support. After image exposure, a processing composition is spread between this and a cover sheet. After the image receiving layer is peeled away by means of a peeling layer which is provided between the photosensitive layer and the image receiving layer, the image is viewed through a transparent support, as disclosed, for example, in JP -A-59-220727 (the term "JP-A" as used herein means "unexamined published Japanese patent application"). Moreover, included is the type in which the photosensitive layer and the image receiving layer are provided by coating on the same support. After image exposure, a processing composition is spread between this and a cover sheet. After the image receiving layer is peeled away by means of a peeling layer which is provided between the photosensitive layer and the image receiving layer, the image is viewed directly and not through the support, as disclosed, for example, in Japanese Patent Application No. 62-231374.

The intended prints cannot be obtained unless peeling occurs at the prescribed peeling position in the above-described peel-apart type diffusion transfer photographic film units. Hence, disclosures have been made already, for example, in JP-A-47-8237, JP-A-59-220727, JP-A-59-229555, JP-A-49-4653, JP-A-6060642, U.S. Pat. Nos. 3,220,835 and 4,359,518, JP-A-49-4334, JP-A-56-65133, JP-A-45-24075, and U.S. Pat. Nos. 3,227,550, 2,759,825, 4,401,746 and 4,366,227.

Water soluble (or alkali soluble) cellulose derivatives are actual examples of materials used for peeling layers. For example, use can be made of hydroxyethylcellulose, cellulose acetate phthalate, plasticized methylcellulose, ethylcellulose, cellulose nitrate, carboxymethylcellulose etc. Various naturally occurring macromolecular materials, for example alginic acid, pectin, gum arabic etc., can also be used for this purpose. Moreover, use can also be made of a variety of modified gelatins, such as acetylated gelatin, phthalated gelatin etc. Moreover, water soluble synthetic polymers can also be used for this purpose. Examples of such materials include poly(vinyl alcohol), polyacrylate, poly(methyl methacrylate), butyl methacrylate, or copolymers thereof.

However, there are problems when these materials are used for peeling layers. First, it is difficult to arrange for stability over all time periods when peeling is carried over a period ranging from about 1 minute to about a day after spreading the processing fluid. Second, if a large amount of the peeling material is used to provide fairly stable peeling properties, then the material leaves the peeled surfaces sticky due to the presence of most of this material. This results in handling difficulties. This latter problem is more pronounced in the case of short term peeling.

No peeling materials or peeling layers which overcome these problems can be found among the conventional technology.

SUMMARY OF THE INVENTION

As a result of thorough research, the inventors have resolved these problems by means of diffusion transfer units of which the distinguishing features are that the peeling layer essentially consists of a layer containing a copolymer which contains repeating units (monomer units) derived from an ethylenic unsaturated carboxylic acid, or a salt thereof, and a layer which contains a cellulose ester.

BRIEF DESCRIPTION OF THE DRAWINGS

The figure represents a photographic film unit, where A is the picture part, B is the spacer rail, C is the processing fluid pod part, D is the liquid stopping part and E are perforations.

DETAILED DESCRIPTION OF THE INVENTION

The provision of a peeling layer containing a combination of layer containing a copolymer which contains repeating units derived from an ethylenic unsaturated carboxylic acid, or a salt thereof, and a cellulose ester layer has an unexpected result in that it resolves completely the two problems indicated above.

The layer containing a copolymer which contains a repeating unit derived from an ethylenic unsaturated carboxylic acid, or a salt thereof, in a peeling layer of this invention is seen to diffuse to some degree into the layer containing a celulose ester. It is thought that it is for this reason that stable peeling, and peeled surfaces which are only slightly sticky, are obtained.

Blurring is liable to occur if, in this invention, the copolymer layer which contains the repeating units derived from ethylenic unsaturated carboxyl groups, or salts thereof, are too thick, while long term peeling is liable to become unstable if this layer is too thin, and so a coating of from 0.01 to 1.2 g/m$^2$, preferably of from 0.03 to 0.6 g/m$^2$, more preferably 0.05 to 0.15 g/m$^2$ and most preferably 0.07 to 0.1 g/m$^2$, is used. Actual preferred examples of the said copolymers which are used in the invention can be represented by the general formula (I) below.

General Formula (I)

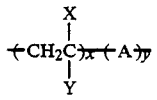

X in this formula represents a hydrogen atom, halogen atom, cyano group or substituted or unsubstituted alkyl group. Y represents a hydrogen atom, halogen atom, cyano group, substituted or unsubstituted alkyl group, $$-\underset{\underset{O}{\|}}{C}-O-R^1$$

group (where $R^1$ is a substituted or unsubstituted alkyl group which has from 1 to 6 carbon atoms or a substituted or unsubstituted aryl group), $$-O-\underset{\underset{O}{\|}}{C}-R^2$$

group (where $R^2$ is a substituted or unsubstituted alkyl group or a substituted or unsubstituted aryl group), $$-\underset{\underset{O}{\|}}{C}-\overset{\overset{R^3}{|}}{N}-R^4 \text{ group, } -\overset{\overset{R^3}{|}}{N}-\underset{\underset{O}{\|}}{C}-R^4$$

group (where $R^3$ and $R^4$ each represents a hydrogen atom, a substituted or unsubstituted alkyl group or a substituted or unsubstituted aryl group, and where R3 and R4 may be the same or different). A represents a repeating unit (monomer unit) which is derived from an ethylenic unsaturated monocarboxylic acid or monocarboxylic acid salt which is copolymerizable with ethylenic unsaturated monomers.

Moreover, x and y are the mol percentages of the monomer components of the copolymer and they may have any values other than zero, preferably x is 5 to 75 and y is 95 to 25, and more preferably x is 20 to 50 and y is 80 to 50.

Examples of substituent groups for the aforementioned substituted alkyl and aryl group include hydroxyl group, halogen atoms (preferably chlorine atoms), cyano groups, alkyl groups and aryl groups.

Those of the copolymers which can be represented by the general formula (I) described below are preferred. That is to say, the preferred copolymers are those in which X is a hydrogen atom or a substituted or unsubstituted alkyl group of which the alkyl residue has from 1 to 4 carbon atoms and Y is a $$-\underset{\underset{O}{\|}}{C}-O-R^1$$

group (where $R^1$ is a substituted or unsubstituted alkyl group of which the alkyl residue has from 1 to 6 carbon atoms), a $$-O-\underset{\underset{O}{\|}}{C}-R^2$$

group (where $R^2$ is a substituted or unsubstituted alkyl group which has from 1 to 6 carbon atoms) or $$-\underset{\underset{O}{\|}}{C}-\overset{\overset{R^3}{|}}{N}-R^4, -\overset{\overset{R^3}{|}}{N}-\underset{\underset{O}{\|}}{C}-R^4$$

(where $R^3$ and $R^4$ are each hydrogen atoms or substituted or unsubstituted alkyl groups which have from 1 to 6 carbon atoms, and $R^3$ and $R^4$ may be the same or different).

Of the groups indicated above for Y, the $$-\underset{\underset{O}{\|}}{C}-O-R^1$$

group or the $$-O-\underset{\underset{O}{\|}}{C}-R^2$$

group is preferred, where $R^1$ and $R^2$ are substituted or unsubstituted alkyl groups of which the alkyl residue has from 1 to 4 carbon atoms.

Monomers represented by the general formula (II) below can be used for the monomer which provides the A component.

$$CH_2=CH-COOR^5 \qquad \text{General formula (II)}$$

($R^5$ in this formula represents a hydrogen atom, $$-R^6-O-\underset{\underset{O}{\|}}{C}-R^7-COOH$$

group or an $-R^6-O-R^8-COOH$ group, $R^6$ and $R^7$ may be the same or different, each represents an alkylene group (preferably an alkylene group which has from 2 to 4 carbon atoms, and more desirably an ethylene group), and $R^8$ represents the aforementioned alkylene groups or an arylene group (preferably a phenylene group). Furthermore, these groups may be further substituted with substituents such as those described earlier.)

The monomers represented by the general formula (II) may be used in the form of salts, and alkali metal ions, alkaline earth metal ions or ammonium ion can be used as cations for forming these salts.

Typical examples of these monomers are indicated below in the free form.

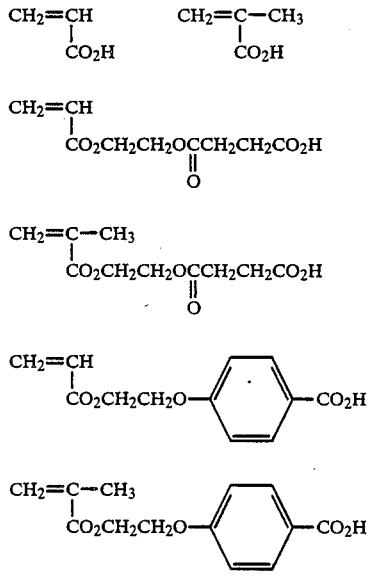

The use of acrylic acid and methacrylic acid from among the above mentioned monomers is especially desirable.

The copolymers represented by the aforementioned general formula (I) may contain copolymerizable monomer components (for example, those derived from the styrenes, such as styrene, α-methylstyrene, 4-methylstyrene, etc.) as well as the aforementioned monomers.

Typical examples of copolymers which can be represented by the general formula (I) are indicated below.

1. $\text{-}(CH_2CH)_{30}\text{-}\ \text{-}(CH_2CH)_{70}\text{-}$ ; $CO_2\text{-n-}C_4H_9$ ; $CO_2Na$ 2. $\text{-}(CH_2CH)_{55}\text{-}\ \text{-}(CH_2C(CH_3))_{45}\text{-}$ ; $CO_2\text{-n-}C_4H_9$ ; $CO_2H$ 3. $\text{-}(CH_2CH)_{30}\text{-}\ \text{-}(CH_2CH)_{70}\text{-}$ ; $CO_2\text{-n-}C_4H_9$ ; $CO_2CH_2CH_2OC(=O)CH_2CH_2CO_2H$ 4. $\text{-}(CH_2C(CH_3))_{15}\text{-}\ \text{-}(CH_2CH)_{85}\text{-}$ ; $CO_2\text{-n-}C_4H_9$ ; $CO_2H$ 5. $\text{-}(CH_2C(CH_3))_{60}\text{-}\ \text{-}(CH_2C(CH_3))_{40}\text{-}$ ; $CO_2\text{-n-}C_4H_9$ ; $CO_2H$ 6. $\text{-}(CH_2C(CH_3))_{50}\text{-}\ \text{-}(CH_2CH)_{50}\text{-}$ ; $CO_2\text{-n-}C_4H_9$ ; $CO_2CH_2CH_2OC(=O)CH_2CH_2CO_2H$ 7. $\text{-}(CH_2C(CH_3))_{20}\text{-}\ \text{-}(CH_2CH)_{80}\text{-}$ ; $CO_2CH_2CH_2OH$ ; $CO_2H$ 8. $\text{-}(CH_2CH)_{60}\text{-}\ \text{-}(CH_2C(CH_3))_{40}\text{-}$ ; $OC(=O)CH_3$ ; $CO_2H$ 9. $\text{-}(CH_2CH)_{20}\text{-}\ \text{-}(CH_2CH)_{80}\text{-}$ ; $CO_2CH_2CH_2OH$ ; $CO_2CH_2CH_2OC(=O)CH_2CH_2CO_2H$ 10. $\text{-}(CH_2\text{-}CH(CH_3))_{15}\text{-}\ \text{-}(CH_2CH)_{85}\text{-}$ ; $CO_2CH_3$ ; $CO_2H$ 11. $\text{-}(CH_2\text{-}CH(CH_3))_{50}\text{-}\ \text{-}(CH_2CH)_{50}\text{-}$ ; $CO_2CH_3$ ; $CO_2H$ 12. $\text{-}(CH_2\text{-}CH(CH_3))_{70}\text{-}\ \text{-}(CH_2CH)_{30}\text{-}$ ; $CO_2CH_3$ ; $CO_2H$ -continued 13. $\text{-}(CH_2\text{-}CH)_{50}\text{-}\ \text{-}(CH_2CH)_{50}\text{-}$ ; $CO_2C_2H_5$ ; $CO_2H$ 14. $\text{-}(CH_2\text{-}CH)_{30}\text{-}\ \text{-}(CH_2CH)_{70}\text{-}$ ; $CO_2C_2H_5$ ; $CO_2H$ 15. $\text{-}(CH_2\text{-}CH)_{60}\text{-}\ \text{-}(CH_2CH)_{40}\text{-}$ ; $CO_2CH_2CH_2OH$ ; $CO_2H$ 16. $\text{-}(CH_2\text{-}CH(CH_3))_{50}\text{-}\ \text{-}(CH_2CH)_{50}\text{-}$ ; $CO_2C_6H_{13}$ ; $COOH$ 17. $\text{-}(CH_2\text{-}CH)_{50}\text{-}\ \text{-}(CH_2CH)_{50}\text{-}$ ; $CON(CH_3)_2$ ; $CO_2H$

Synthesis Example of the Preparation of a Copolymer for Use in a Peeling Layer Synthesis of Polyacrylic acid/butylmethacrylate copolymer:

Ethanol (450 ml) and 30 ml of distilled water were placed in a 1 liter capacity three necked flask which was fitted with a stirrer, a reflux condenser, a dropping funnel, a mercury thermometer and a nitrogen feed pipe and the mixture was heated on a water bath. When the temperature inside the flask had reached and stabilized at 70° C., 0.4 grams of 2,2'-azobis-(2-amidinopropane) hydrochloride polymerization initiator was added, after which a mixture consisting of 184 grams of acrylic acid monomer and 64 grams of n-butyl methacrylate monomer was added slowly from the dropping funnel over a period of 3 hours. Two further additions, each of 0.4 grams, of the aforementioned polymerization initiator were added at intervals of 1 hour. More of the aforementioned polymerization, initiator (0.4 grams on each occasion) was added on four occasions at 1 hourly intervals after completion of the dropwise addition, and polymerization was carried out with stirring for a further 5 hours at 70° C.

After the heating and stirring had been stopped, the temperature inside the flask was reduced to room temperature and the contents of the flask were removed.

Recovery: 645 grams, Polymer solid fraction concentration: 40%, Viscosity: 50 cp (in 20% ethanol solution, 25° C., E-type viscometer).

The layer comprising cellulose ester in the peeling layers of this invention is saponified by the alkali in the processing fluid in the development process to form a water permeable layer. Thus, if it is too thick it delays dye permeation. Furthermore, if this layer is too thin it has no shielding effect on the colorants or long term stable peeling effect, and so an amount of from 0.02 to 0.9 $g/m^2$ is appropriate, an amount of from 0.05 to 0.6 $g/m^2$ is preferred, an amount of 0.1 to 0.4 $g/m^2$ is more preferred, and an amount of 0.15 to 0.35 $g/m^2$ is most preferred. Any of the cellulose esters which can undergo alkaline hydrolysis can be used for this purpose, and examples of such cellulose esters include cellulose triacetate, cellulose diacetate, cellulose propionate, cellulose acetate butyrate, etc.

The preferred embodiments of the invention have a peeling layer comprising a layer containing a copolymer which can be represented by the aforementioned general formula

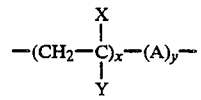

and the cellulose esters indicated above provided between the image receiving layer and the photosensitive layer in a peel-apart type diffusion transfer photographic film unit which has at least an image receiving layer and a photosensitive layer on a support.

More preferably, the peeling layer comprising a layer containing a copolymer which contains a repeating unit (monomer unit) derived from an ethylenic unsaturated carboxylic acid which can be represented by the aforementioned general formula

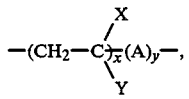

or a salt thereof, and a layer which contains the aforementioned cellulose ester, is provided in a color diffusion transfer photographic film unit which comprises a photosensitive element which has provided sequentially on a white support at least (a) a layer which has a neutralizing function, (b) a dye image receiving layer, (c) a peeling layer and (d) at least one silver halide emulsion layer associated with dye image forming substances, an alkali processing composition which contains a light shielding agent, and a transparent cover sheet, and which has a layer which has a light shielding function on the opposite side of the emulsion layer to that on which the processing composition is spread.

Each of these structural elements is described in order below.

(A) Support

The white support preferably used in the invention is a support of which at least the side upon which the dye image receiving layer is coated is white. Any support which has adequate whiteness and smoothness can be used for this purpose. For example, the use of polymer films which have been rendered white by the addition of white pigments, such as titanium oxide, barium sulfate, zinc oxide, etc., of particle size 0.1 to 5 μ, or by forming micro-voids by stretching, for example, films and synthetic papers made from polyethyleneterephthalate, polystyrene or polypropylene which has been formed into a film using the normal method of successive biaxial stretching, or supports obtained by laminating polyethylene, polyethyleneterephthalate, or polypropylene, for example, which contains titanium white, onto both sides of a sheet of paper, is preferred. The thickness of the support is from 50 to 350 μm, preferably from 70 to 210 μm, and more preferably from 80 to 150 μm.

Furthermore, a light shielding layer can be provided in the support, as required. For example, use can be made of a support obtained by laminating polyethylene which contains a light shielding agent, such as carbon black, on the back of a white support.

Any of the carbon blacks made using the channel method, the thermal method, or the furnace method, as described, for example, by Donnet Voet in "Carbon Black", Marcel Dekker Inc. (1976), can be used for this purpose.

No particular limits are imposed on the particle size of the carbon black, but those with a particle size of from 90 to 1800 Å are preferred.

The amount of black pigment added as a light shielding agent may be adjusted according to the sensitivity of the photosensitive material which is being shielded, but an optical density of from about 5 to 10 is desirable.

(B) Dye Image Receiving Layer

The dye image receiving layer used in the invention is a layer which contains a mordant in a hydrophilic colloid. This may take the form of a single layer or it may have a multi-layer construction obtained by providing by coating mordants which have different mordanting strengths as a laminate. Such a layer has been described, for example, in JP-A-61-252551. The use of polymeric mordants is preferred.

The polymeric mordants which can be used in the invention include polymers which contain secondary or tertiary amino groups, polymers which have nitrogen containing heterocyclic portions, and polymers which contain quaternary ammonium cation groups thereof, of which the molecular weight is at least 5,000, and preferably at least 10,000.

Examples include the vinylpyridine polymers and vinylpyridinium cation polymers described, for example, in U.S. Pat. Nos. 2,548,564, 2,484,430, 3,148,061 and 3,756,814; the vinylimidazolium cation polymers described, for example, in U.S. Pat. No. 4,124,386; the polymer mordants which can crosslink with gelatin and the like as described, for example, in U.S. Pat. Nos. 3,625,694, 3,859,096 and 4,128,538, and British Patent No. 1,277,453; the aqueous sol type mordants described, for example, in U.S. Pat. Nos. 3,958,995, 2,721,852 and 2,798,063, JP-A-54-115228, JP-A-54-145529, JP-A-54-126027, JP-A-54-155835 and JP-A-56-17352; the water insoluble mordants described, for example, in U.S. Pat. No. 3,898,088; the reactive mordants which can form covalent bonds with dyes as described, for example, in U.S. Pat. Nos. 4,168,976 and 4,201,840; and the mordants described, for example, in U.S. Pat. Nos. 3,709,690, 3,788,855, 3,642,482, 3,488,706, 3,557,066, 3,271,147 and 3,271,148, JP-A-53-30328, JP-A-52-155528, JP-A-53-125, JP-A-53-1024, JP-A-53-107835, and British Patent No. 2,064,802.

The mordants disclosed in U.S. Pat. Nos. 2,675,316 and 2,882,156 can also be used for this purpose.

Those of these mordants which are not prone to migrate from the mordant layer into another layer are preferred, and the mordants which undergo a crosslinking reaction with a matrix such as gelatin for example, the water insoluble mordants and the aqueous sol type mordants (including latex dispersions) are preferred. The latex dispersion mordants are especially desirably, and those which have a particle size of from 0.01 to 2 μand preferably from 0.05 to 0.2 μ, are preferred.

The amount of mordant coated differs according to the type of mordant, the quaternary cation content, the type and amount of dye which is to be mordanted, and the type of binder which is used, etc., but it is from 0.5 to 10 g/m$^2$, preferably from 1.0 to 5.0 g/m$^2$, and particularly preferably from 2 to 4 g/m$^2$.

Gelatin, poly(vinyl alcohol), polyacrylamide, polyvinylpyrrolidone, etc. can be used as the hydrophilic colloid which is used in the image receiving layer, but the use of gelatin is preferred.

(C) Layer Which Has a Neutralizing Function

The layer which has a neutralizing function used in the invention is a layer which contains a sufficient quantity of an acidic substance to neutralize the alkali introduced from the processing composition, and it may have a multi-layer structure containing a neutralization rate adjusting layer (timing layer) and an adhesion reinforcing layer, as required. The preferred acidic substances are substances which have acidic groups of which the pKa value is not more than 9 (or precursor groups which provide such acidic groups on hydrolysis), and preferred substances include higher fatty acids, such as oleic acid as disclosed in U.S. Pat. No. 2,983,606, acrylic acid, methacrylic acid or maleic acid polymers and partial esters or acid anhydrides thereof, such as those described in U.S. Pat. No. 3,362,819, acrylic acid/acrylate ester copolymers such those described in French Patent No. 2,290,699, and latex type acidic polymers such as those described, for example, in U.S. Pat. No. 4,139,383 and *Research Disclosure* No. 16102 (1977).

The acidic substances described, for example, in U.S. Pat. No. 4,088,493, JP-A-52-153739, JP-A-53-1023, JP-A-53-4540, JP-A-53-4541 and JP-A-53-4542 can also be used for this purpose.

Actual examples of acidic polymers include copolymers of ethylene and vinyl monomers such vinyl acetate and vinyl methyl ether, with maleic anhydride, and their n-butyl esters, copolymers of butyl acrylate and acrylic acid, and cellulose acetate hydrodienephthalate.

The aforementioned polymeric acids can be mixed and used with hydrophilic polymers. Polymers of this type include polyacrylamide, polyvinylpyrrolidone, poly(vinyl alcohol) (including partially saponified products), carboxymethyl cellulose, hydroxymethylcellulose, hydroxyethylcellulose, poly(methyl vinyl ether), etc. Of these, polyvinylalcohol is preferred. Furthermore, polymers other than hydrophilic polymers, for example, cellulose acetate, can be added to the aforementioned polymeric acids.

The amount of polymeric acid coated is adjusted according to the amount of alkali which is to be spread on the photosensitive element. The equivalent ratio of polymeric acid and alkali per unit area is preferably from 0.9 to 2.0. If the amount of polymeric acid is too low this can result in changes in the hue of the transferred dyes and staining of the white background parts, while the use of too much polymeric acid can result in changes in hue and other disadvantages such as reduced resistance to light. Moreover, the preferred equivalent ratio is from 1.0 to 1.3. The admixture of too little or too much hydrophilic polymer lowers the quality of the photograph. The ratio by weight of hydrophilic polymer to polymeric acidr is from 0.1 to 10, and preferably from 0.3 to 3.0.

Additivefs can be included for various purposes in the layers which have a neutralizing function in this invention. For example, the film hardening agents well known in the art can be included to harden the layer, and polyhydroxyl compounds, such as polyethyleneglycol, polypropyleneglycol and glycerine, can be added for improving the brittleness of these films. Other additives, such as antioxidants, fluorescent whiteners, dyes for providing a blueing effect, development inhibitors, and precursors thereof, can also be added, as required.

The timing layers which are used in conjunction with the neutralizing layers may composed of polymers which have a low alkali permeability, such as gelatin, poly(vinyl alcohol), partially acetalated poly(vinyl alcohol), cellulose acetate and partially hydrolyzed poly(vinyl acetate); latex polymers which have been made by copolymerization with small amounts of hydrophilic co-monomers such as acrylic acid monomer and which have a high activation energy for alkali permeation; or polymers which have lactone rings.

From among these materials, the timing layers in which cellulose acetate is used as disclosed, for example, JP-A-54-136328 and U.S. Pat. Nos. 4,267,262, 4,009,030, and 4,029,849, the latex polymers obtained by copolymerization with small amounts of a hydrophilic comonomer such as acrylic acid as disclosed, for example, in JP-A-54-128335, JP-A-56-69629 and JP-A-57-6843, and U.S. Pat. Nos. 4,056,394, 4,061,496, 4,199,362, 4,250,243, 4,256,827 and 4,268,604, the polymers which have lactone rings described in U.S. Pat. No. 4,229,516; and the other polymers described, for example, in JP-A-56-25735, JP-A-56-97346, JP-A-57-6842, and European Patents Nos. 31957Al, 37724Al and 48412Al are especially useful.

Use can also be made of those disclosed in the documents indicated below:

U.S. Pat. Nos. 3,421,393, 3,455,686, 3,575,701, 3,778,265, 3,785,815, 3,847,615, 4,088,493, 4,123,275, 4,148,653, 4,201,587, 4,288,523 and 4,297,431, West German Patent Applications Nos. (OLS) 1,622,936 and 2,162,277, and *Research Disclosure* 15162, No. 151 (1976).

The timing layers in which these materials are used can take the form of a single layer, or two or more types of layer may be used jointly.

Development inhibitors and/or precursors thereof, as described, for example, in U.S. Pat. No. 4,009,029, West German Patent Applications (OLS) 2,913,164 and 3,014,672, JP-A-54-155837 and JP-A-55-138745, and the hydroquinone precursors described in U.S. Pat. No. 4,201,578, and other photographically useful additives or precursors thereof, can be incorporated into timing layers containing these materials.

(D) Light Shielding Layer

In this invention, processing can be carried out in daylight because the photosensitive layer is completely shielded from external light during the development process by the light shielding layer in the photosensitive element and the light shielding properties of the processing fluid which is spread over the photosensitive element during processing. In practical terms, a layer which contains a light shielding agent can be provided by coating on the back of the support, or between the emulsion layer and the support, or a layer which contains a light shielding agent may be provided within the support. Any material which has a light shielding function can be used as a light shielding agent, but the use of carbon black is preferred.

Any binder in which carbon black can be dispersed can be used as a binder for providing by coating the light shielding agent, but the use of gelatin is preferred.

Light shielding of the photosensitive layer in this invention is achieved by shielding one side (surface) of the photosensitive layer by spreading a processing composition which has a light shielding capacity, and by providing a layer which contains a light shielding agent on the opposite side (surface) of the photosensitive layer (a) between the photosensitive layer and the white support, (b) in the white support itself and/or (c) on the back (the opposite side to the photosensitive layer) of the white support. At this time, light shielding can be achieved using all of (a), (b) and (c), in which case the light shielding function of each may be inadequate.

(E) Photosensitive Layer

A photosensitive layer containing silver halide emulsion layers with which dye image forming substances are incorporated is provided above the aforementioned peeling layer in this invention. The structural elements of such a layer are described below.

(1) Dye Image Forming Substances

The dye image forming substances used in the invention are non-diffusible compounds which release diffusible dyes (or dye precursors) corresponding to the silver image, or compounds of which the diffusion properties of the compound itself are changed in accordance with the silver image, and such compounds have been described in the fourth edition of "The Theory of the Photographic Process". These compounds can be represented by the general formula (I') below.

DYE-Y (I')

Here, DYE represents a dye or a dye precursor, and Y represents a component which provides a compound which has different diffusion properties from the compound under alkaline conditions. The compounds can be broadly classified as negative type compounds which become diffusible in the silver developed parts, or as positive type compounds which become diffusible in the non-developed parts, according to the function of Y.

Actual examples of Y in compounds of the negative type include those which are destroyed by oxidation as a result of development, and which thereby release a diffusible dye.

Actual examples of Y have been disclosed in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A51-104343, JP-A-54-130122, JP-A-53-110827, 12642, JP-A-56-16131, JP-A-57-4043, JP-A-57-650, JP-A57-20735, JP-A-53-69033, JP-A-54-130927, JP-A-56-164342 and JP-A-57-119345.

N-substituted sulfamoyl groups (with groups derived from aromatic hydrocarbon rings or heterocyclic rings as the N-substituent group) are especially desirable as the Y group for negative type dye releasing redox compounds. Examples of typical groups for Y are indicated below, but Y is not limited to these groups.

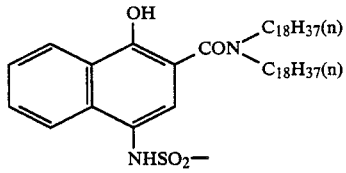

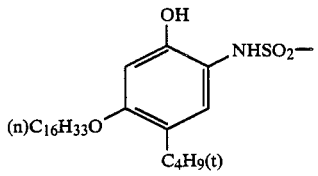

-continued

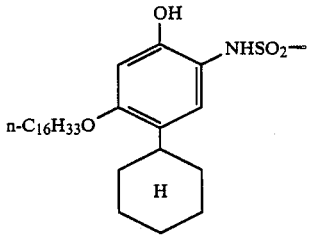

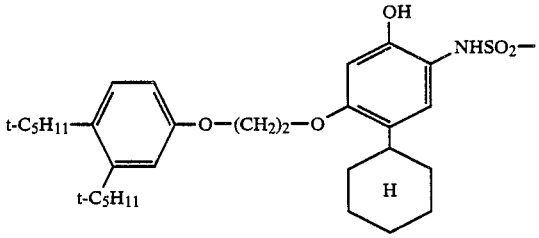

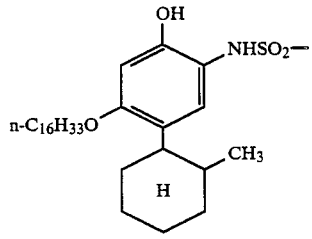

Positive type compounds have been described in Angev. Chem., Int. Ed., Engl., Volume 22, page 191 (1982).

Actual examples include compounds (dye developing agents}which are diffusible under the initial alkaline conditions but which are oxidized by development and become non-diffusible. Typical examples of Y which can be used in compounds of this type have been disclosed in U.S. Pat. No. 2,983,606.

Furthermore, with another type of compound a diffusible dye is released as a result of spontaneous ring closure under alkaline conditions, but the release of the dye is essentially stopped when oxidation occurs with development. Actual examples of Y which have such a function have been disclosed, for example, in U.S. Pat. No. 3,980,479, JP-A-53-69033, JP-A-54-130927 and U.S. Pat. Nos. 3,421,964 and 4,199,355.

With another type of compound, the compound does not release a dye itself, but a dye is released when reduction occurs. Compounds of this type are used in combination with electron donors, and the diffusible dye can be released in the form of the image by reaction with residual electron donor which has been oxidized in the form of the image by silver development. Atomic groups which have a function of this type have been disclosed, for example, in U.S. Pat. Nos. 4,183,753, 4,142,891, 4,278,750, 4,139,379 and 4,218,368, JP-A-53110827, U.S. Pat. Nos. 4,356,249 and 4,358,525, JP-A-54130927, JP-A-56-164342, Kokai Giho No. 87-6199 and European Patent No. 220,746A2.

Actual examples are indicated below, but they are not limited to just these examples.

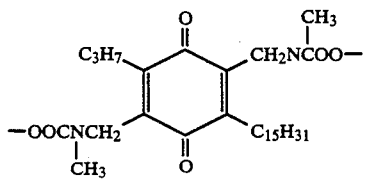

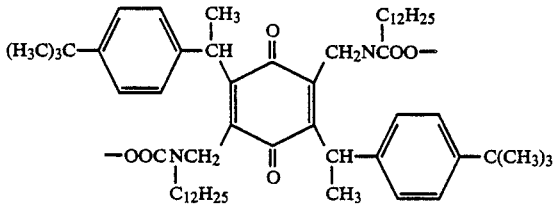

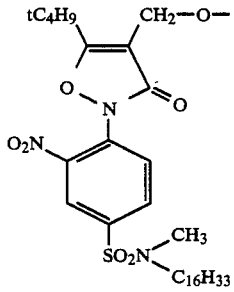

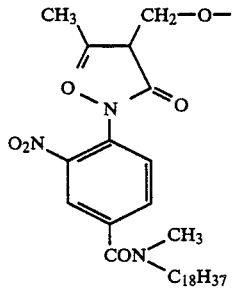

A combination with non-diffusible electron donating compounds (commonly known as ED compounds) or precursors thereof for use is preferred when compounds of this type are being used. Examples of ED compounds have been disclosed, for example, in U.S. Pat. Nos. 4,263,393 and 4,278,750 jand JP-A-56-138936.

Compounds of the type indicated below can be used as actual examples of another type of dye image forming substance.

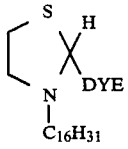

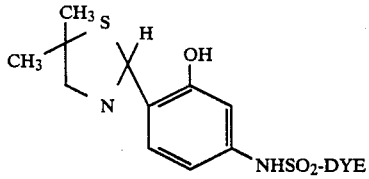

(In these formulae, DYE represents a dye or a dye precursor as described earlier.)

Details of these compounds have been disclosed, for example, in U.S. Pat. Nos. 3,719,489 and 4,098,783.

On the other hand, actual examples of dyes which can be represented by DYE in the aforementioned general formulae have been disclosed in the references as indicated below.

Examples of yellow dyes have been disclosed in U.S. Pat. Nos. 3,597,200, 3,309,199, 4,013,633, 4,245,028, 4,156,609, 4,139,383, 4,195,992, 4,148,641, 4,148,643 and 4,336,322; JP-A-51-114930, JP-A-56-71072; *Research Disclosure* 17630 (1978) and *Research Disclosure* 16475 (1977).

Examples of magenta dyes have been disclosed in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292; JP-A-52-106727, JP-A-53-23628, JP-A-55-36804, JP-A-56-73057, JP-A-56-71060 and JP-A-55-134.

Examples of cyan dyes have been disclosed in U.S. Pat. Nos. 3,482,972, 3,929,760, 4.013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431, JP-A-56-71061, European Patents 53,037 and 53,040, *Research Disclosure* 17630 (1978) and *Research Disclosure* 16475 (1977).

(2) Silver Halide Emulsions

The silver halide emulsions used in the invention may be negative emulsions in which the latent image is formed principally on the surface of the silver halide grains, or internal latent image type direct positive emulsions in which the latent image is formed within the silver halide grains.

The internal latent image type direct positive emulsions are, for example, so-called "conversion" emulsions which have been made using differences in the solubilities of silver halides, or "core/shell" type emulsions in which at least the photosensitive sites of the internal (core) grains of a silver halide which has been doped with metal ions or chemically sensitized, or both doped with metal ions and chemically sensitized, are covered with an outer mantle (shell) of silver halide, and these have been disclosed, for example, in U.S. Pat. Nos. 2,592,250 and 3,206,313, British Patent No.1,027,146, U.S. Pat. Nos. 3,761,276, 3,935,014, 3,447,927, 2,497,875, 2,563,785, 3,551,662 and 4,395,478, West German Patent No. 2,728,108, and U.S. Pat. No. 4,431,730.

Furthermore, when internal latent image type direct positive emulsions are used it is necessary to introduce fogging nuclei onto the grain surface either by exposure to light or by means of a nucleating agent after image exposure.

Nucleating agents which can be used for this purposes include, for example, the hydrazines disclosed in U.S. Pat. Nos. 2,563,785 and 2,588,982, the hydrazides and hydrazones disclosed in U.S. Pat. No. 3,227,552, the heterocyclic quaternary salt compounds disclosed, for example, in British Patent No. 1,283,835, JP-A-52-69613, and U.S. Pat. Nos. 3,615,615, 3,719,494, 3,734,738, 4,094,683 and 4,115,122, the sensitizing dyes which have substituent groups which have a nucleating action within the dye molecule, as disclosed in U.S. Pat. No. 3,718,470, thiourea bond type acylhydrazine based compounds as disclosed, for example, in U.S. Pat. Nos. 4,030,925, 4,031,127, 4,245,037, 4,255,511, 4,266,013, and 4,276,364, and British Patent No. 2,012,443, and the acylhydrazine based compounds which have a thioamido group or a heterocyclic group, such as a triazole or a tetrazole, as an adsorption group, as disclosed, for example, in U.S. Pat. Nos. 4,080,270 and 4,278,748, and British Patent No. 2,011,391B.

Spectrally sensitizing dyes can be used in combination with these negative type emulsions and internal latent image type direct positive emulsions in this invention. Actual examples have been disclosed, for example, in JP-A-59-180550, JP-A-60-140335, *Research Disclosure* (RD) 17029, and U.S. Pat. Nos. 1,846,300, 2,078,233, 2,089,129, 2,165,338, 2,231,658, 2,719,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470 and 4,025,349.

(3) Structure of the Photosensitive Layer

At least two photosensitive layers in which emulsions which have been spectrally sensitized with the above mentioned spectrally sensitizing dyes are combined with the aforementioned dye image forming substances which provide dyes which have a selective spectral absorbance in the same wavelength range are required to reproduce natural colors using the subtractive color method. The emulsion and the dye image forming substance can be provided by coating as separate laminated layers or they can be mixed together and provided by coating as a single layer. In cases where, in the coated state, the dye image forming substance has an absorption in the spectrally sensitive region of the emulsion with which it is combined, the two are preferably coated in separate layers. Furthermore, the emulsion layer may consist of a plurality of emulsion layers which have different speeds, and optional layers may be provided between the emulsion layers and the dye image forming substance layer. For example, layers which contain nucleation development accelerators as disclosed in JP-A-60-173541, and separating layers as disclosed in JP-B-60-15267 may be provided in order to increase the colored image density, and reflecting layers as disclosed in JP-A-60-91354 can be provided in order to increase the speed of the photosensitive elements.

In the preferred multi-layer structure, the blue sensitive emulsion combination unit, the green sensitive emulsion combination unit and the red sensitive emulsion combination unit are provided in this order from the side which is to be exposed to light.

Optional layers can be provided, as required, between each of the emulsion layer units. The provision of intermediate layers is especially desirable for preventing the effect of the development of a certain emulsion layer from having an unwanted effect in another emulsion layer unit.

Intermediate layers which contain non-diffusible reducing agents are preferred in cases where developing agents are used in combination with non-diffusible dye image forming substances in order to prevent the diffusion of the oxidized form of the developing agent. Actual examples include non-diffusible hydroquinones, sulfonamidophenols and sulfonamidonaphthols, and further actual examples have been disclosed, for example, in JP-B-50-21249, JP-B-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393 and 3,700,453, British Patent No. 557,750, JP-A-57-24941 and JP-A-58-21249. Furthermore, methods for their dispersion have been disclosed in JP-A-60-238831 and JP-B-60-18978.

The inclusion in the intermediate layers of compounds which trap silver ions is desirable in cases where compounds with which the diffusible dye is released by silver ions as disclosed in JP-B-55-7576, are being used.

Anti-irradiation layers, separating layers and protective layers, etc. can be provided by coating, as required, in this invention.

(F) Processinq Composition

The processing compositions used in the invention are spread uniformly over the photosensitive element after the photosensitive element has been exposed and together with the light shielding layer provided on the back of the support or on the opposite side of the photosensitive layer from the processing fluid, they completely shield the photosensitive layer from external light and at the same time the photosensitive layer is developed by means of the components contained within the composition. For this purposes, the composition contains alkali, viscosity increasing agent, light shielding agent and developing agent and, moreover, development accelerators and development inhibitors, and antioxidants for controlling development, etc. for preventing the deterioration of the developing agent. A light shielding agent is invariably included in the composition.

The alkali is one which provides a fluid pH of 12 to 14, and examples include alkali metal hydroxides (for example, sodium hydroxide, potassium hydroxide, lithium hydroxide), alkali metal phosphates (for example, potassium phosphate), guanidines, and the hydroxides of quaternary amines (for example, trimethylammonium hydroxide) but, of these, the use of potassium hydroxide and sodium hydroxide is preferred.

The viscosity increasing agents are required to spread the processing fluid evenly and to maintain the adhesion between the photosensitive layer and the cover sheet when the used photosensitive layer is peeled away together with the cover sheet. For example, use can be made of poly(vinyl alcohol), hydroxyethylcellulose and alkali metal salts of carboxymethylcellulose, and the use of hydroxyethylcellulose and sodium carboxymethylcellulose is preferred.

Any dyes or pigments, or combinations thereof, can be used for the light shielding agent, provided that they do not diffuse into the dye image receiving layer and cause staining. Carbon black is typical of the materials used for this purpose, but combinations of dyes and titanium white can also be used. Temporary light shielding dyes which become colorless after processing for a fixed time can also be used as dyes for this purpose.

The preferred developing agents are any of those which undergo cross oxidation with the dye image forming substance and cause essentially no staining even when oxidized. Developing agents of this type can be used individually or two or more types can be used jointly, and they can also be used in the form of precursors. These developing agents may be included in an appropriate layer of the photosensitive element or in the alkaline processing fluid. Aminophenols and pyrazolidinones are actual examples of such compounds but, of these, the use of the pyrazolidinones is preferred because of the lower degree of staining.

For example, use can be made of 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone or 1-p-tolyl-4-methyl-4-hydroxymethyl-3-pyrazolidinone.

(G) Cover Sheet, etc.

A transparent cover sheet is used for spreading the processing fluid uniformly over the photosensitive element in this invention. The cover sheet is peeled away together with the processing fluid and the used photosensitive layer after processing. Hence, a cover sheet which has been subjected to a surface treatment so as to provide adequate adhesion with the processing fluid, or on which a suitable adhesion layer has been provided by coating, is preferred. Furthermore, filter dyes can be included in the cover sheet to adjust the sensitivity of the photosensitive layer. The filter dyes can be included directly in the cover sheet support, or they may be provided by coating in a separate layer.

Any of the smooth, transparent supports normally used in photographic materials can be used for the cover sheet which is used in the invention, and materials such as cellulose acetate, polystyrene, polyethyleneterephthalate and polycarbonate, etc. can be used for this purpose, and they may be provided with an underlayer.

The under-layer coating liquids normally used in photographic materials can be used for the underlayers. Furthermore, layers which have a neutralizing function and layers which trap dyes which have diffused to the cover sheet side can also be included in the cover sheet.

The following examples are provided for illustrative purposes only and are in no way intended to limit the scope of the present invention.

EXAMPLE 1

The layers (i) and (ii) indicated below were provided by coating on one side of a PET support which contained titanium white pigment. Then, layers (1) to (26) indicated below were provided sequentially by coating on the other side of the support to provide the image receiving photosensitive sheet (A).

(i) A light shielding layer containing 3.0 g/m$^2$ of carbon black and 4.5 g/m$^2$ of gelatin.

(ii) A white layer containing 3.0 g/m$^2$ of titanium white and 1.0 g/m$^2$ of gelatin.

(1) A neutralizing layer containing 4.0 g/m$^2$ of poly(acrylic acid), 4.0 g/m$^2$ of poly(vinyl alcohol) and 0.04 g/m$^2$ of 1,4-bis(2,3-epoxypropoxy)butane.

(2) A timing layer containing 6 g/m$^2$ of a 95:5 (by weight) mixture of 55% acetylated cellulose acetate and the methyl half ester of a methyl vinyl ether/maleic anhydride (mol ratio 1:1) copolymer.

(3) An adhesion reinforcing layer containing 0.4 g/m$^2$ of hydroxyethyl methacrylate.

(4) A layer containing 2.5 g/m$^2$ total solid fraction of a mixture blended in the proportions of solid fraction 6:4 of a polymer latex obtained by the emulsion polymerization of styrene/butyl acrylate/acrylic acid/N-methylolacrylic acid amide in the proportions by weight of 49.7/42.3/4/4 and a polymer latex obtained by the emulsion polymerization of methyl methacrylate/acrylic acid/N-methylolacrylamide in the proportions by weight of 93/3/4.

(5) A mordanting layer containing 3 g/m$^2$ of the polymer latex mordant indicated below and 3 g/m2 of gelatin.

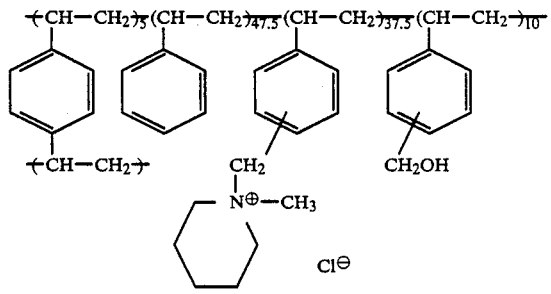

(6) A first peeling layer containing 0.06 g/m$^2$ of the compound indicated below.

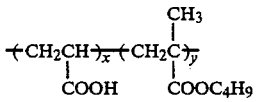

x/y = 85/15

(7) A second peeling layer containing 0.5 g/m$^2$ of 51% acetylated cellulose acetate.

(8) A layer containing 1 g/m$^2$ of ethyl acrylate latex and 2.5 g/m$^2$ of gelatin.

(9) A layer containing 0.44 g/m$^2$ of the cyan dye releasing redox compound indicated below, 0.09 g/m$^2$ of tricyclohexyl phosphate, 0.008 g/m$^2$ of 2,5-di-tert-pentadecylhydroquinone, 0.05 g/m$^2$ of carbon black and 0.8 g/m$^2$ of gelatin.

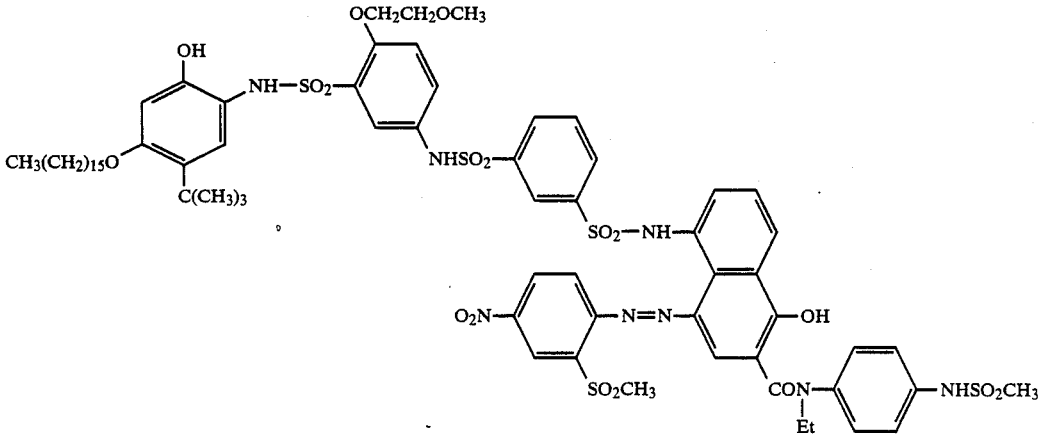

(10) A light reflecting layer containing 2 g/m$^2$ of titanium oxide and 0.5 g/m$^2$ of gelatin.

(11) A low speed red sensitive emulsion layer containing an octahedral internal latent image type direct positive silver bromide emulsion having a grain size of 1.0 μm (0.15 g/m² as silver), 3 mg/m² of the red sensitive sensitizing dye indicated below, 0.4 g/m² of gelatin, 1.1 μg/m² of the nucleating agent (NA) indicated below, and 0.02 g/m² of the sodium salt of 2-sulfo-5-n-pentadecylhydroquinone.

Red Sensitive Sensitizing Dye

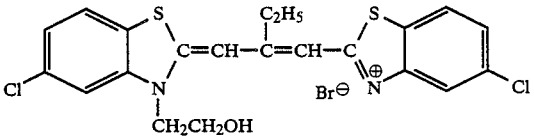

NA

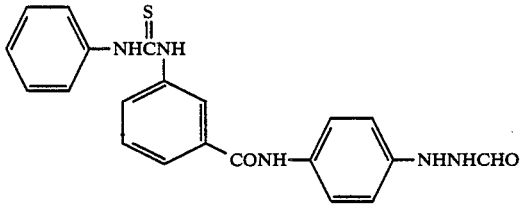

(12) A high speed red sensitive emulsion layer containing an octahedral internal latent image type direct positive silver bromide emulsion having a grain size of 1.6 μm (0.5 g/m² as silver), 3 mg/m² of the same red sensitive sensitizing dye as used in layer (11), 0.8 g/m² of gelatin, 3.0 μg/m² of the same nucleating agent (NA) as in layer (11), and 0.04 g/m² of the sodium salt of 2-sulfo-5-n-pentadecylhydroquinone.

(4') A red sensitive emulsion layer containing an octahedral internal latent image type direct positive silver bromide emulsion having a grain size of 1.0 μm (0.6 g/m² as silver), 3 mg/m² of the same red sensitive sensitizing dye as used in layer (11), 1 g/m² of gelatin, 0.015 mg/m² of the same nucleating agent (NA) as used in layer (11), and 0.06 g/m² of the sodium salt of 2-sulfo-5-n-pentadecylhydroquinone.

(13) An anti-color mixing layer containing 1.2 g/m² of 2,5-di-tert-pentadecylhydroquinone, 1.2 g/m² of poly(methyl methacrylate) and 0.7 g/m² of gelatin.

(14) A layer containing 0.3 g/m² of gelatin.

(15) A layer containing 0.5 g/m² of the magenta dye releasing redox compound indicated below, 0.1 g/m² of tricyclohexyl phosphate, 0.009 g/m² of 2,5-di-tert-pentadecylhydroquinone and 0.9 g/m² of gelatin.

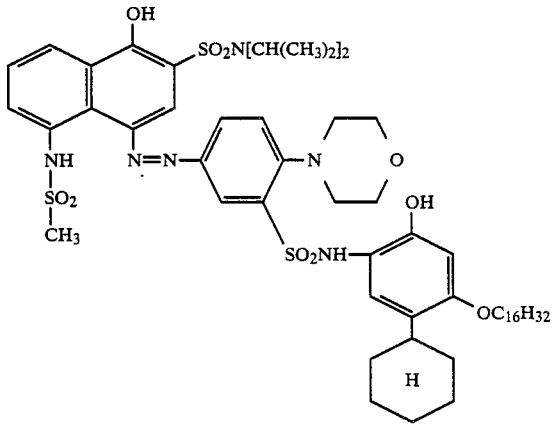

(16) A light reflecting layer containing 1 g/m² of titanium oxide and 0.25 g/m² of gelatin.

(17) A low speed green sensitive emulsion layer containing an octahedral internal latent image type direct positive silver bromide emulsion having a grain size of 1.0 μm (0.12 g/m² as silver), 3 mg/m² of the green sensitive sensitizing dye indicated below, 0.25 g/m2 of gelatin, 1.1 μg/m² of the same nucleating agent (NA) as used in layer (11), and 0.02 g/m² of the sodium salt of 2-sulfo-5-n-pentadecylhydroquinone.

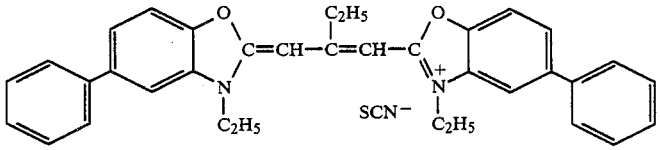

(18) A high speed green sensitive emulsion layer containing an octahedral internal latent image type direct positive silver bromide emulsion having a grain size of 1.6 μm (0.35 g/m² as silver), 3 mg/m² of the same green-sensitive sensitizing dye as used in layer (17), 0.7 g/m² of gelatin, 1.7 μg/m² of the same nucleating agent (NA) as used in layer (11), and 0.04 g/m² of the sodium salt of 2-sulfo-5-n-pentadecylhydroquinone.

(19) An anti-color mixing layer containing 0.8 g/m² of 2,5-di-tert-pentadecylhydroquinone, 0.8 g/m² of poly(methyl methacrylate) and 0.45 g/m² of gelatin.

(20) A layer having the same composition as layer (14).

(21) A layer containing 0.53 g/m² of the yellow dye releasing redox compound indicated below, 0.13 g/m² of tricyclohexyl phosphate, 0.014 g/m² of 2,5-di-tert-pentadecylhydroquinone and 0.7 g/m² of gelatin.

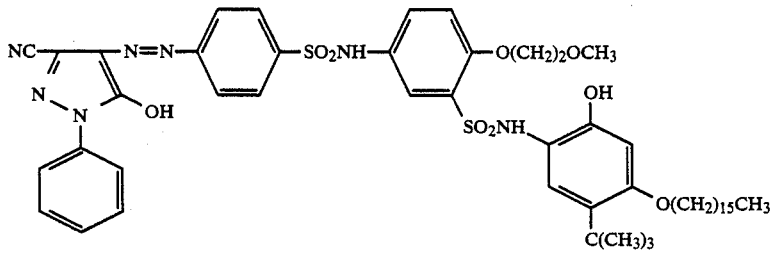

(22) A light reflecting layer containing 0.7 g/m$^2$ of titanium oxide and 0.18 g/m$^2$ of gelatin.

(23) A low speed blue sensitive emulsion layer containing an octahedral internal latent image type direct positive silver bromide emulsion having a grain size of 1.1 μm (0.25 g/m$^2$ as silver), 3 mg/m$^2$ of the blue sensitive sensitizing dye indicated below, 0.4 g/m$^2$ of gelatin, 2 μg/m$^2$ of the same nucleating agent (NA) as used in layer (11), and 0 045 g/m$^2$ of the sodium salt of 2-sulfo-5-n-pentadecylhydroquinone.

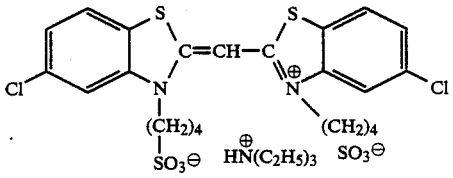

(24) A high speed blue sensitive emulsion layer containing an octahedral internal latent image type direct positive silver bromide emulsion having a grain size of 1.7 μm (0.42 g/m$^2$ as silver), 3 mg/m$^2$ of the same blue sensitive sensitizing dye as used in layer (23), 0.45 g/m$^2$ of gelatin, 3.3 μg/mz of the same nucleating agent (NA) as used in layer (11), and 0.025 g/m$^2$ of the sodium salt of 2-sulfo-5-n-pentadecylhydroquinone.

(25) An ultraviolet absorbing layer containing $4\times10^{-4}$ mol/m$^2$ of each of the ultraviolet absorbers indicated below, and 0.5 g/m$^2$ of gelatin.

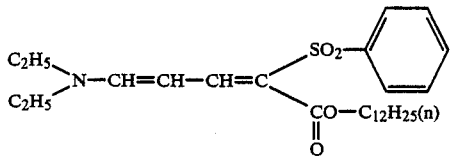

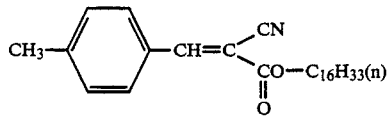

(26) A protective layer containing 0.1 g/m$^2$ of matting agent and 1.0 g/m$^2$ of gelatin.

Next, photosensitive image receiving sheet (B) was prepared in the same way as photosensitive image receiving sheet (A) except that the second peeling layer (7) was omitted. Furthermore, photosensitive image receiving sheet (C) was prepared in the same way as photosensitive image receiving sheet (A) except that the first peeling layer (6) was omitted.

Next, an alkali processing fluid which contained a light shielding agent was prepared as indicated below and this was packed into a processing fluid pod.

| Processing Fluid | |
|---|---|
| 1-m-Tolyl-4-hydroxymethyl-4-methyl-3-pyrazolidone | 10 g |
| 1-Phenyl-4-hydroxymethyl-4-methyl-3-pyrazolidone | 4 g |
| 5-Methylbenzotriazole | 1.2 g |
| Benzotriazole | 6 g |
| Potassium sulfite | 8 g |
| Carboxymethylcellulose | 45 g |
| Potassium hydroxide | 64 g |
| Benzyl alcohol | 3.4 g |
| Carbon black | 150 g |
| Water to make up to a total weight of | 1 kg |

Cover Sheet

A cover sheet was prepared by coating the layers indicated below on a transparent polyethyleneterephthalate support which contained a dye for preventing the occurrence of light piping and which had a gelatin under-layer.

(1) A neutralizing layer containing 3 g/m$^2$ of cellulose acetate (55.5% acetylated) and 2 g/m$^2$ of methyl vinyl ether/maleic anhydride copolymer.

(2) A layer containing 3.9 g/m$^2$ total solid fraction of a mixture blended in the proportions of solid fraction 5:5 of a polymer latex obtained by the emulsion polymerization of styrene/butyl acrylate/acrylic acid/N-methylolacrylamide in the proportions by weight of 49.7/42.3/4/4 and a polymer latex obtained by the emulsion polymerization of methyl methacrylate/acrylic acid/N-methylolacrylamide in the proportions by weight of 93/3/4.

(3) A mordant layer which contained 1 g/m$^2$ of the polymer latex mordant indicated below and 1 g/m$^2$ of gelatin.

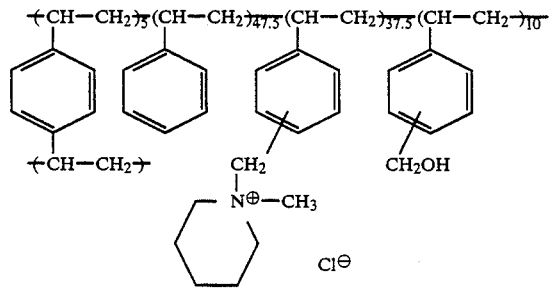

The above mentioned photosensitive sheets (A)-(C) were combined with processing fluid pods and cover sheets to provide unified units like that shown in the Figure.

Discontinuous perforations were introduced in the way disclosed in JP-A-56-67840 into the support on the side on which the processing fluid pod was attached.

The film units were exposed through the cover sheet using a color test chart, after which they were passed between a pair of rollers and the processing fluid in the processing pod was spread uniformly between the photosensitive element and the cover sheet. The cover sheets were peeled away by strongly folding and breaking the part E at fixed times after spreading the processing fluid. At this time, the wet peeling properties were evaluated in terms of the proportion of the area from which the peeling layer had peeled away cleanly and in which the intended picture was obtained. When perfect peeling was carried out this was shown as 100%. On the other hand, the force required to peel the layers (7) to (26) away from the photosensitive sheet was measured using a Tensilon tensile strength measuring machine made by the Toyo Bauldwin Co. Furthermore, stickiness was evaluated by covering the surface with a sheet of ordinary photocopying paper immediately after peeling, leaving the combination to stand for 10 minutes under a load of 50 g/m$^2$ and then peeling the two apart and evaluating the state of adhesion on the picture surface and the paper side. (0: No adhesion, Δ: Slight adhesion, X: Serious adesion). The results are shown in Table 1 below.

TABLE 1

| Photo-Sensitive Sheet | Peeling Layer | Time After Spreading Processing Fluid Before Peeling | Wet Peeling (%) | Dry Peeling (g/cm) | Stickiness |
|---|---|---|---|---|---|
| (A) | (6) + (7) | 1 minute | 100 | 20 | O |
| | | 60 minutes | 100 | 30 | O |
| | | 24 hours | 100 | 20 | O |
| (B) | (6) Only | 1 minute | 20 | 150 | X |
| | | 60 minutes | 10 | 140 | Δ |
| | | 24 hours | 10 | 120 | O |
| (C) | (7) Only | 1 minute | 40 | 100 | Δ |
| | | 60 minutes | 80 | 60 | O |
| | | 24 hours | 10 | 130 | O |

It is clear from Table 1 that when a peeling layer of this invention was used, the wet and dry peeling properties were good over a period from 1 minute to 24 hours, and that after peeling, the stickiness of the surfaces were at the good (0) level.

EXAMPLE 2

A carbon black layer (3.0 g/m$^2$ of carbon black and 4.5 g/m$^2$ of gelatin) and a titanium white layer (3.0 g/m$^2$ of titanium white and 1.0 g/m$^2$ of gelatin) were coated sequentially as a light shielding layer on the back surface of a polyethylene terephthalate support which contained titanium white pigment.

Next, the layers indicated below were coated sequentially onto the opposite side of the support to the light shielding layer and the image receiving photosensitive sheet (A) was obtained.

(1) A neutralizing layer containing 30 g/m$^2$ of the butyl half ester of a 1:1 copolymer of maleic anhydride and vinyl methyl ether (average molecular weight about 100,000), 0.05 g/m$^2$ of titanium dioxide and 0.8 g/m$^2$ of the compound indicated below.

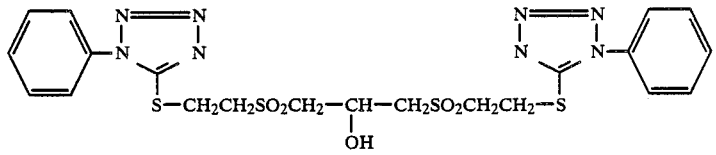

(2) A timing layer containing 0.49 g/m$^2$ of a 60:30:4:6 copolymer of butyl acrylate, diacetoneacrylamide, styrene and methacrylic acid, and 0.01 g/m$^2$ of polyacrylamide.

(3) An image receiving layer containing 3.2 g/m$^2$ of poly-4-vinylpyridine (average molecular weight 80,000), and 3.2 g/m$^2$ of poly(vinyl alcohol) (98% saponified, average molecular weight about 80,000).

(4) A first peeling layer containing 0.1 g/m$^2$ of the compound indicated below.

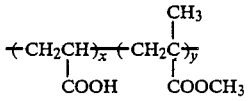

x/y =70/30

(5) A second peeling layer containing 0.3 g/m$^2$ of 51% acetylated cellulose acetate.

(6) A layer containing 1 g/m$^2$ of ethyl acrylate latex and 2.5 g/m$^2$ of gelatin.

(7) A red sensitive emulsion layer containing a negative silver iodobromide emulsion (iodine content 2 mol%, 2.3 g/m$^2$ as silver), 1.7 g/m$^2$ of gelatin, and 3 mg/m$^2$ of the red sensitive sensitizing dye 3,3',9-triethyl-5,5'-dichlorothiacarbocyanine iodide.

(8) A layer containing 0.8 g/m$^2$ of the temporarily short wave length shifted cyan dye developing agent indicated below, 0.8 g/m$^2$ N,N-diethyllaurylamide and 1.1 g/m$^2$ of gelatin.

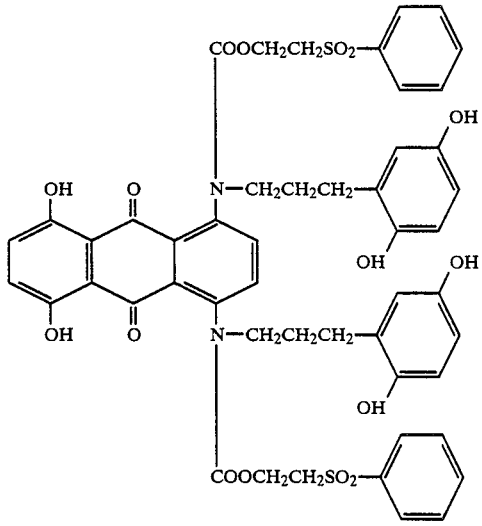

(9) A layer containing 3.5 g/m$^2$ of gelatin.

(10) A green sensitive emulsion layer containing a negative silver iodobromide emulsion (iodine content 2 mol%, 1.7 g/m$^2$ as silver), 1.3 g/m$^2$ of gelatin and 3 mg/m$^2$ of the green sensitizing dye 3,3',9-triethyl-5-5'-diphenyloxycarbocyanine bromide.

(11) A layer containing 0.6 g/m$^2$ of the temporary short wave length shifted magenta dye developing agent of which the structure is indicated below, 0.6 g/m$^2$ of N,N-diethyllaurylamide and 1.2 g/m$^2$ of gelatin.

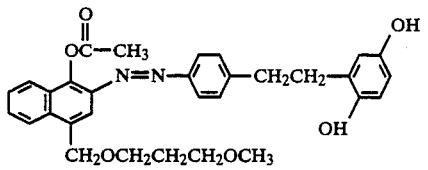

(12) A layer containing 3.0 g/m$^2$ of gelatin.

(13) A blue sensitive emulsion layer containing a negative silver iodobromide emulsion (iodine content 2 mol%, 1.8 g/m$^2$ as silver), and 1.6 g/m$^2$ of gelatin.

(14) A layer containing 1.0 g/m$^2$ of the temporary short wave length shifted yellow dye developing agent of which the structure is indicated below, 1.0 g/m$^2$ of N,N-diethyllaurylamide and 1.8 g/m$^2$ of gelatin.

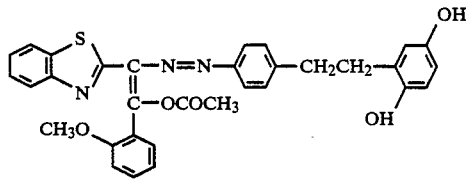

(15) A layer containing 0.45 g/m$^2$ of 4'-methylphenylhydroquinone, 0.45 g/m2 of tri-o-cresyl phosphate and 1.3 g/m$^2$ of gelatin (mucochloric acid was also included in the amount of 0.02 g/m$^2$ as a film hardening agent).

Next, a photosensitive image receiving sheet (B) was prepared in the same way as photosensitive image receiving sheet (A) except that the second peeling layer (5) was omitted. Furthermore, photosensitive image receiving sheet (C) was prepared in the same way as photosensitive image receiving sheet (A) except that the first peeling layer (4) was omitted.

Next, an alkali processing fluid which contained a light shielding agent was prepared as indicated below, and this was packed into a processing fluid pod.

| Processing Fluid | |
|---|---|
| N-Benzyl-α-picolinium bromide | 20 g |
| Benzotriazole | 15 g |
| Carboxymethylcellulose | 35 g |
| Potassium hydroxide | 95 g |
| Carbon black | 150 g |
| Water to make up to a total weight of | 1 kg |

Cover Sheet

A transparent polyethylene terephthalate support which contained a dye for preventing the occurrence of light piping and which had a gelatin under-layer was used as a cover sheet as in Example 1.

The above mentioned photosensitive sheets (A) to (C) were combined with processing fluid pods and cover sheets to provide unified units like that shown in the Figure.

Discontinuous perforations were introduced in the way disclosed in JP-A-56-67840 into the support on the side on which the processing fluid pod was attached.

The film units were exposed through the cover sheet using a color test chart, after which they were passed between a pair of rollers and the processing fluid in the processing pod was spread uniformly between the photosensitive element and the cover sheet. The cover sheets were peeled away by strongly folding and breaking the part E at fixed times after spreading the processing fluid. Wet peeling, dry peeling and stickiness were then evaluated in the same way as in Example 1. The results obtained are shown in Table 2 below.

TABLE 2

| Photo-Sensitive Sheet | Peeling Layer | Time After Spreading Processing Fluid Before Peeling | Wet Peeling (%) | Dry Peeling (g/cm) | Stickiness |
|---|---|---|---|---|---|
| (A) | (4) + (5) | 1 minute | 100 | 15 | O |
| | | 60 minutes | 100 | — | O |
| | | 24 hours | 100 | — | O |
| (B) | (4) Only | 1 minute | 15 | 140 | X |
| | | 60 minutes | 13 | — | X |
| | | 24 hours | 9 | — | Δ |
| (C) | (5) Only | 1 minute | 40 | 50 | O~Δ |
| | | 60 minutes | 70 | — | O |
| | | 24 hours | 5 | — | O |

It is clear from Table 2 that when a peeling layer of this invention is used the wet peeling and dry peeling are good and the prints are also good with respect to stickiness.

EXAMPLE 3

Peeling layers were formed using the compounds (1) to (5) indicated below in place of the first peeling layer in Example 1, and in all cases the peeling properties were good and the prints were good with respect to stickiness.

1. $(CH_2CH)_{30}(CH_2CH)_{70}$ ($CO_2$-n-$C_4H_9$, $CO_2Na$) ; 50 mg/m$^2$

2. $(CH_2CH)_{20}(CH_2CH)_{80}$ ($CO_2CH_2CH_2OH$, $CO_2CH_2CH_2OC(=O)CH_2CH_2COOH$) ; 100 mg/m$^2$

3. $(CH_2-CH)_{50}(CH_2-C(CH_3))_{50}$ ($CO_2CH_2H_5$, $CO_2H$) ; 150 mg/m$^2$

-continued

4. $$\left(CH_2-\underset{\substack{|\\ CO_2C_6H_{13}}}{\overset{\substack{CH_3\\ |}}{CH}}\right)_{50}\left(CH_2\underset{\substack{|\\ CO_2H}}{CH}\right)_{50}$$ ; 60 mg/m$^2$ 5. $$\left(CH_2-\underset{\substack{|\\ CON(CH_3)_2}}{CH}\right)_{50}\left(CH_2\underset{\substack{|\\ CO_2H}}{CH}\right)_{50}$$ ; 100 mg/m$^2$ While the invention has been described in detail and with reference to specific embodiments thereof, it will be apparent to one skilled in the art that various changes and modifications can be made therein without departing from the spirit and scope thereof.

What is claimed is:

1. A peel-apart type diffusion transfer unit comprising at least an image receiving layer and a peeling layer on a support, wherein the peeling layer essentially consists of (A) a layer containing a copolymer which contains repeating units (monomer units) derived from an ethylenic unsaturated carboxylic acid or a salt thereof, and (B) a layer which contains a cellulose ester.

2. The peel-apart type diffusion transfer unit as claimed in claim 1, wherein said copolymer is represented by general formula(I):

$$\left(CH_2\underset{\substack{|\\ Y}}{\overset{\substack{X\\ |}}{C}}\right)_x\left(A\right)_y$$

wherein X represents a hydrogen atom, a halogen atom, a cyano group, or a substituted or unsubstituted alkyl group; Y represents a hydrogen atom, a halogen atom, a cyano group, or a substituted or unsubstituted alkyl group: a $$-\underset{\substack{\|\\ O}}{C}-O-R^1$$

group, wherein $R^1$ is a substituted or unsubstituted alkyl group which has from 1 to 6 carbon atoms or a substituted or unsubstituted aryl group, a $$-O-\underset{\substack{\|\\ O}}{C}-R^2$$

group, wherein $R^2$ is a substituted or unsubstituted alkyl group or a substituted or unsubstituted aryl group, a $$-\underset{\substack{\|\\ O}}{C}-\overset{\substack{R^3\\ |}}{N}-R^4 \text{ group, a } -\overset{\substack{R^3\\ |}}{N}-\underset{\substack{\|\\ O}}{C}-R^4$$

group, wherein $R^3$ and $R^4$ each represents a hydrogen atom, a substituted or unsubstituted alkyl group or a substituted or unsubstituted aryl group and wherein $R^3$ and $R^4$ may be the same or different: wherein x and y are the mol percentages of the monomer components of the copolymer and are values greater than 0.

3. The peel-apart type diffusion transfer unit as claimed in claim 2, wherein X is a hydrogen atom or a substituted or unsubstituted alkyl group of which the alkyl residue has from 1 to 4 carbon atoms and Y is a $$\left(CH_2\underset{\substack{|\\ Y}}{\overset{\substack{X\\ |}}{C}}\right)_x\left(A\right)_y$$

group, wherein $R^1$ is a substituted or unsubstituted alkyl group of which the alkyl residue has from 1 to 6 carbon atoms, a $$-O-\underset{\substack{\|\\ O}}{C}-R^2$$

group, wherein $R^2$ is a substituted or unsubstitued alkyl group of which the alkyl residue has from 1 to 6 carbon atoms, $$-\underset{\substack{\|\\ O}}{C}-\overset{\substack{R^3\\ |}}{N}-R^4,$$

$$-\overset{\substack{R^3\\ \|}}{N}-\underset{\substack{\|\\ O}}{C}-R^4,$$

wherein $R^3$ and $R^4$ are each hydrogen atoms or substituted or unsubstituted alkyl groups of which the alkyl residues have from 1 to 6 carbon atoms, and $R^3$ and $R^4$ may be the same or different.

4. The peel-apart type diffusion transfer unit as claimed in claim 1, wherein said copolymer is employed in an amount of from 0.01 to 1.2 g/m$^2$.

5. The peel-apart type diffusion transfer unit as claimed in claim 4, wherein said copolymer is employed in an amount of from 0.03 to 0.6 g/m$^2$.

6. The peel-apart type diffusion transfer unit as claimed in claim 1, wherein said cellulose ester is employed in an amount of from 0.2 to 0.9 g/m$^2$.

7. The peel-apart type diffusion transfer unit as claimed in claim 6, wherein said cellulose ester is employed in an amount of from 0.05 to 0.6 g/m$^2$.

8. The peel-apart type diffusion transfer unit as claimed in claim 1, wherein said cellulose ester is selected from the group consisting of cellulose triacetate, cellulose diacetate, cellulose propionate and cellulose acetate butyrate.

9. The peel-apart type diffusion transfer unit as claimed in claim 1, wherein said peeling layer is provided between the image receiving layer and a photosensitive layer.

* * * * *